US005961399A

United States Patent [19]

Boyle

[11] Patent Number: 5,961,399

[45] Date of Patent: Oct. 5, 1999

[54] MODIFIED PUTTER

[76] Inventor: James T. Boyle, 117 W. Carolina Ave., Summerville, S.C. 29483

[21] Appl. No.: 09/133,448

[22] Filed: Aug. 13, 1998

[51] Int. Cl.[6] ..... A63B 53/04

[52] U.S. Cl. ..... 473/328; 473/340

[58] Field of Search ..... 473/340, 313, 473/341, 328, 251, 252, 226

[56] References Cited

U.S. PATENT DOCUMENTS

| | | | |
|---|---|---|---|
| 3,625,517 | 12/1971 | Durnack | 473/340 |
| 4,199,144 | 4/1980 | Skelly | 473/340 |
| 5,286,027 | 2/1994 | Koumarianos | 473/340 |
| 5,607,365 | 3/1997 | Wolf | 473/328 |
| 5,749,793 | 5/1998 | Lucetti | 473/324 |

*Primary Examiner*—Kien T. Nguyen

[57] ABSTRACT

A modified putter is provided including an elongated shaft. Coupled to the shaft is a club including an upper extent and a lower extent extending downwardly from the upper extent. The lower extent comprises a pair of protrusions which are situated adjacent to opposed sides of the upper extent.

1 Claim, 2 Drawing Sheets

MODIFIED PUTTER

BACKGROUND OF THE INVENTION

1. Field of the Invention

The present invention relates to putters and more particularly pertains to a new modified putter for ensuring that a sweet spot of a putter is raised a predetermined distance from the ground.

2. Description of the Prior Art

The use of putters is known in the prior art. More specifically, putters heretofore devised and utilized are known to consist basically of familiar, expected and obvious structural configurations, notwithstanding the myriad of designs encompassed by the crowded prior art which have been developed for the fulfillment of countless objectives and requirements.

Known prior art putters include U. S. Pat. No. 4,113,249; U.S. Pat. No. 5,437,447; U.S. Pat. No. 5,058,895; U.S. Pat. No. 4,540,179; U.S. Pat. No. 4,163,554; and U.S. Pat. Des. 350,177.

In these respects, the modified putter according to the present invention substantially departs from the conventional concepts and designs of the prior art, and in so doing provides an apparatus primarily developed for the purpose of ensuring that a sweet spot of a putter is raised a predetermined distance from the ground.

SUMMARY OF THE INVENTION

In view of the foregoing disadvantages inherent in the known types of putters now present in the prior art, the present invention provides a new modified putter construction wherein the same can be utilized for ensuring that a sweet spot of a putter is raised a predetermined distance from the ground.

The general purpose of the present invention, which will be described subsequently in greater detail, is to provide a new modified putter apparatus and method which has many of the advantages of the putters mentioned heretofore and many novel features that result in a new modified putter which is not anticipated, rendered obvious, suggested, or even implied by any of the prior art putters, either alone or in any combination thereof.

To attain this, the present invention generally comprises an elongated shaft with a grip mounted adjacent to a top of the shaft. An offset portion of the shaft is mounted adjacent to a bottom of the shaft. As shown in FIG. 3, the offset portion remains in parallel with a remaining portion of the shaft. Next provided is a club including an upper extent with a rectangular configuration. As shown in the Figures, the upper extent has a planar rectangular front face, a planar rectangular rear face and a periphery formed therebetween. Such periphery is defined by a rectangular top face, a rectangular bottom face and a pair of side faces. The club has a predetermined length and width. As shown in FIG. 1, the top face of the club is coupled to the bottom end of the shaft such that the shaft defines an acute angle with the top face of the club. The club further includes a lower extent defined by a pair of semi-circular portions integrally coupled to the bottom face of the periphery of the upper extent. The semi-circular portions define protrusions which extend downwardly from the upper extent in coplanar relationship therewith. Each semi-circular portion of the lower extent has a diameter approximately equal to the predetermined width and approximately ¼ the predetermined length. It should be further noted that a thickness of each semi-circular portion of the lower extent is constant, uniform and equal to that of the upper extent.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Pat. and Trademark Office and the public generally, and especially the scientists, engineers and practitioners in the art who are not familiar with patent or legal terms or phraseology, to determine quickly from a cursory inspection the nature an essence of the technical disclosure of the application. The abstract is neither intended to define the invention of the application, which is measured by the claims, nor is it intended to be limiting as to the scope of the invention in any way.

It is therefore an object of the present invention to provide a new modified putter apparatus and method which has many of the advantages of the putters mentioned heretofore and many novel features that result in a new modified putter which is not anticipated, rendered obvious, suggested, or even implied by any of the prior art putters, either alone or in any combination thereof.

It is another object of the present invention to provide a new modified putter which may be easily and efficiently manufactured and marketed.

It is a further object of the present invention to provide a new modified putter which is of a durable and reliable construction.

An even further object of the present invention is to provide a new modified putter which is susceptible of a low cost of manufacture with regard to both materials and labor, and which accordingly is then susceptible of low prices of sale to the consuming public, thereby making such modified putter economically available to the buying public.

Still yet another object of the present invention is to provide a new modified putter which provides in the apparatuses and methods of the prior art some of the advantages thereof, while simultaneously overcoming some of the disadvantages normally associated therewith.

Still another object of the present invention is to provide a new modified putter for ensuring that a sweet spot of a putter is raised a predetermined distance from the ground.

Even still another object of the present invention is to provide a new modified putter that includes an elongated shaft. Coupled to the shaft is a club including an upper extent and a lower extent extending downwardly from the upper extent. The lower extent comprises a pair of protrusions which are situated adjacent to opposed sides of the upper extent.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
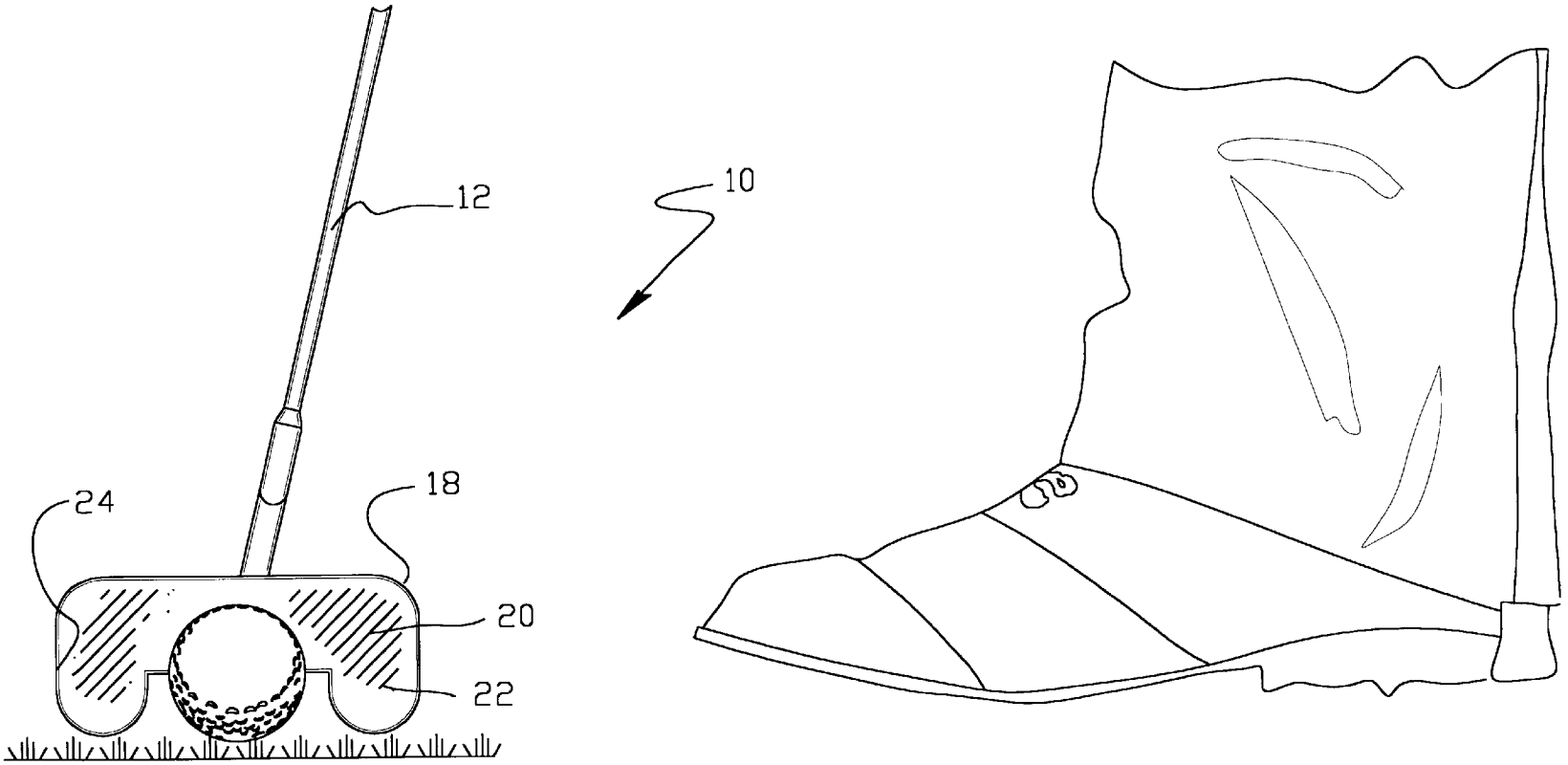
FIG. 1 is a front view of a new modified putter according to the present invention.
Figure 2:
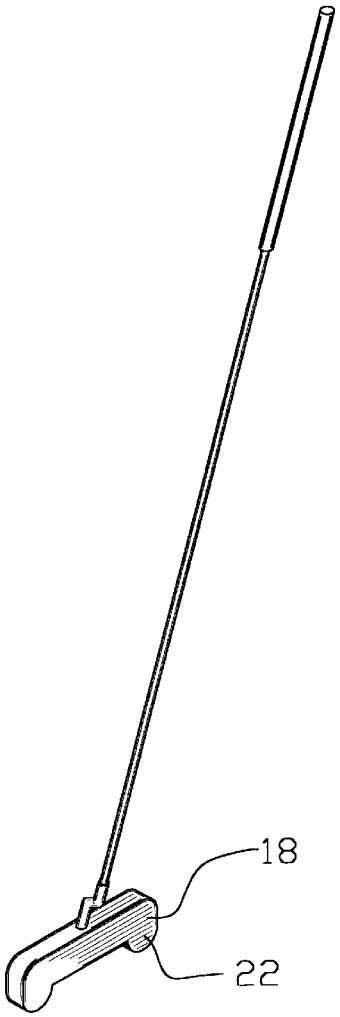
FIG. 2 is a perspective view of the present invention.

With reference now to the drawings, and in particular to FIGS. 1 through 4 thereof, a new modified putter embodying the principles and concepts of the present invention and generally designated by the reference numeral 10 will be described.

Figure 3:
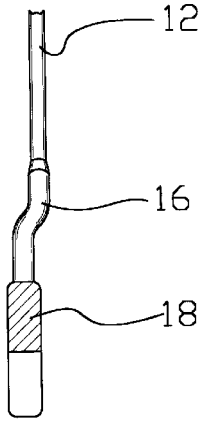
FIG. 3 is a side cross-sectional view of the present invention.
Figure 4:
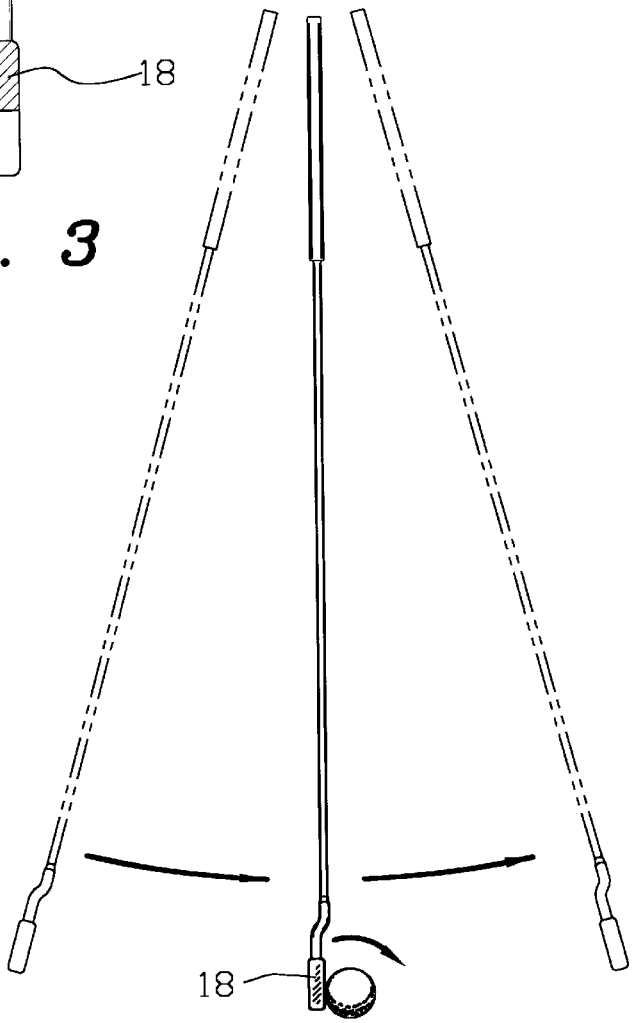
FIG. 4 is a side view of the present invention in use.

The present invention, designated as numeral 10, includes an elongated shaft 12 with a grip mounted adjacent to a top of the shaft. An offset portion 16 of the shaft is mounted adjacent to a bottom of the shaft. As shown in FIG. 3, the offset portion remains in parallel with a remaining portion of the shaft.

Next provided is a club 18 including an upper extent 20 with a rectangular configuration. As shown in the Figures, the upper extent has a planar rectangular front face, a planar rectangular rear face and a periphery formed therebetween. Such periphery is defined by a rectangular top face, a rectangular bottom face and a pair of side faces. The club has a predetermined length and width. As shown in FIG. 1, the top face of the club is coupled to the bottom end of the shaft such that the shaft defines an acute angle with the top face of the club.

The club further includes a lower extent 22 defined by a pair of semi-circular portions 24 integrally coupled to the bottom face of the periphery of the upper extent. The semi-circular portions define protrusions which extend downwardly from the upper extent in coplanar relationship therewith. In the preferred embodiment, each protrusion extends downwardly about ¾ of an inch. It should noted that such dimension constitutes a general radius of each protrusion. Each semi-circular portion of the lower extent has a diameter approximately equal to the predetermined width and approximately ¼ the predetermined length. It should be further noted that a thickness of each semi-circular portion of the lower extent is constant, uniform and equal to that of the upper extent. As such, the protrusions also define a pair of cylindrical halves.

In use, the protrusions of the putter of the present invention ensures that the "sweet spot" of the putter remains ¾ of an inch from the ground. This feature prevents skidding of the ball which is common with conventional putters. For example, with prior art putters, the ball is contacted at a center point which in turn forces the ball to skid a short distance. This skidding is conducive to undesirable deflection of the ball. To overcome such problem, the protrusions of the present invention, ensure that the ball is contacted above its center thus imparting a top spin. In addition, the protrusions increase the heel and toe weighting so that the putter does not twist on an off-center hit. Further, less dragging of the putter along the ground is permitted due to the inherent reduced surface area of the putter. It should be noted that the club of the present invention may be constructed in various mallet and perimeter-weighted styles. Also, various grips may be employed.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and shall equivalent relationships to those illustrated in the drawing and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A modified putter comprising, in combination:

an elongated shaft with a grip mounted adjacent to a top of the shaft and an offset portion mounted adjacent to a bottom of the shaft, the offset portion remaining in parallel with a remaining portion of the shaft; and a club including an upper extent having a planar rectangular front face, a planar rectangular rear face and a periphery formed therebetween defined by a rectangular top face, a rectangular bottom face and a pair of side faces extending perpendicularly between the top and bottom faces of the upper extent, the club having a predetermined length and width, the top face of the club being coupled to the bottom end of the shaft such that the shaft defines an acute angle with the top face of the club, the club further including a lower extent defined by a pair of semi-circular portions integrally coupled to the bottom face of the periphery of the upper extent and extending downwardly therefrom in coplanar relationship therewith, each semi-circular portion of the lower extent having a diameter approximately equal to the predetermined width and approximately ¼ the predetermined length, a first of the side faces being tangential to an end of a first of the semi-circular portions, a second of the side faces being tangential to an end of a second of the semi-circular portions;

the semi-circular portions each having planar front and back faces, the front faces of the semi-circular portions being coplanar with the front face of the upper extent, the back faces of the semi-circular portions being coplanar with the rear face of the upper extent, wherein a thickness of each semi-circular portion of the lower extent is constant, uniform and equal to that of the upper extent.

* * * * *